United States Patent [19]

Trulaske et al.

[11] Patent Number: 4,616,822

[45] Date of Patent: Oct. 14, 1986

[54] EXERCISE TREADMILL

[76] Inventors: James A. Trulaske, 609 Sunbridge Dr.; Frank R. Trulaske, 576 Sunbridge Dr., both of Chesterfield, Mo. 63017

[21] Appl. No.: 636,747

[22] Filed: Aug. 1, 1984

[51] Int. Cl.[4] ..... A63B 23/06

[52] U.S. Cl. ..... 272/69; 198/841; 272/DIG. 4

[58] Field of Search ..... 272/69, DIG. 4; 198/841

[56] References Cited

U.S. PATENT DOCUMENTS

| | | | |
|---|---|---|---|
| D. 280,002 | 8/1985 | Smith | D21/192 |
| 1,766,089 | 6/1930 | Wood . | |
| 1,824,406 | 9/1931 | Petersime . | |
| 1,919,627 | 7/1933 | Fitzgerald . | |
| 2,969,768 | 1/1961 | Grant . | |
| 3,118,315 | 1/1964 | Loosli . | |
| 3,332,683 | 7/1967 | Rand . | |
| 3,554,541 | 1/1971 | Seaman . | |
| 3,606,320 | 9/1971 | Erwin, Jr. . | |
| 3,608,898 | 9/1971 | Berlin . | |
| 3,643,943 | 2/1972 | Erwin, Jr. . | |
| 3,659,845 | 5/1972 | Quinton . | |
| 3,689,066 | 9/1972 | Hagen . | |
| 3,703,284 | 11/1972 | Hesen . | |
| 3,711,090 | 1/1973 | Fiedler . | |
| 3,711,812 | 1/1973 | Cherry . | |
| 3,731,917 | 5/1973 | Townsend . | |
| 3,737,163 | 6/1973 | Sumrall . | |
| 3,826,491 | 7/1974 | Elder . | |
| 4,066,257 | 1/1978 | Moller . | |
| 4,227,487 | 10/1980 | Davis . | |
| 4,274,625 | 6/1981 | Gaetano . | |
| 4,334,676 | 6/1982 | Schönenberger . | |
| 4,342,452 | 8/1982 | Summa . | |
| 4,344,616 | 8/1982 | Ogden . | |
| 4,350,336 | 9/1982 | Hanford . | |

*Primary Examiner*—Richard J. Apley
*Assistant Examiner*—John Welsh
*Attorney, Agent, or Firm*—Polster, Polster and Lucchesi

[57] ABSTRACT

An exercise treadmill is disclosed having a flexible, endless belt entrained around a pair of spaced rollers and having a slider bed disposed under the upper reach of the belt. The slider bed is of a heat-conducting metal plate, and is supported by an open frame such that air may freely flow under the slider bed to carry away heat generated by the upper reach of the belt (with the weight of the runner supported thereon) functionally sliding on the slider bed. The frame, slider bed supports, and slider bed are constructed in such manner as to permit limited vertical flexing movement of these parts when a user runs or walks on the upper reach of the belt supported by the slider bed so as to absorb shock and cushion the impact of the user's feet.

7 Claims, 7 Drawing Figures

EXERCISE TREADMILL

BACKGROUND OF THE INVENTION

This invention relates to an exercise treadmill, and more particularly, to an exercise treadmill having an improved slider bed.

Exercise treadmills are utilized in a variety of medical diagnostic and therapeutic treatments, particularly in cardiology. Also, exercise treadmills are utilized by exercise-conscious persons in that treadmills permit a person to more easily simulate a controlled walking, running, or jogging exercise program indoors with a minimum amount of space. The speed of exercise, the duration of the exercise period, and the work expended may be readily controlled by regulating the speed of the treadmill, the length of the exercise period, and by varying the inclination of the treadmill belt.

Typically, an exercise treadmill includes an endless belt entrained around a pair of spaced-apart rollers, with one of the rollers being driven at a predetermined speed such that the upper reach of the treadmill moves from a front to rear direction. In order for the user to remain stationary relative to a handlebar or the frame of the treadmill, the user must walk or run on the upper reach of the belt. By increasing or decreasing the surface speed of the belt, and by changing the inclination of the belt, the degree of physical energy expended by the user to keep pace with the belt may be selectively varied.

The upper reach of the belt must be supported. This may be accomplished by providing a plurality of closely-spaced rollers immediately below the upper reach of the belt. While these rollers provide little resistance to the movement of the belt and thus generate little or no friction on the belt, the rollers provide an uneven surface which may be felt by the user as he walks or runs on the belt. Another typical manner of supporting the belt is to provide a stationary slider plate or platen immediately below the upper reach of the belt. While this continuous slider plate or platen provides a continuous and, thus, a more comfortable surface for supporting the upper reach of the belt while the user runs or walks thereon, the use of a stationary slider plate generates considerably more friction with the moving belt, particularly in the areas where the user's foot momentarily contacts the belt. This friction results in the generation of heat, and may lead to excessive wear on the belt and/or the slider bed.

Numerous attempts have been made to overcome the problem of friction between the belt and the slider bed. The slider bed has been covered with a wax impregnated canvas, as shown in U.S. Pat. No. 3,659,845. Additionally, the slider belt has been made with a plurality of downwardly compressible air cells, and of a low friction (e.g., Teflon-coated nylon contact sheet, as shown in U.S. Pat. No. 3,689,066). Additionally, attempts have been made to provide for controlled leakage of air cells in order to provide an "air bearing" effect for journaling the upper reach of the belt on the bed. In Hesen, U.S. Pat. No. 3,703,284, a friction-reducing material (e.g., Teflon) has been utilized to cover the slider bed. It has also been suggested that the slider bed be made of a low-friction material, such as highly polished melamine (Formica) resin, as shown in U.S. Pat. No. 3,731,917.

Reference may also be made to such U.S. Pat. Nos. as 1,766,089, 1,824,406, 1,919,627, 2,969,768, 3,118,315, 3,332,683, 3,554,541, 3,606,320, 3,608,898, 3,643,943, 3,711,090, 3,711,812, 3,737,163, 3,826,491, 4,066,257, 4,227,487, 4,274,625, 4,334,676, 4,342,452, 4,344,616, and 4,350,336, in the same general field as the present invention.

However, in all of the prior art treadmills, the problems of belt and slider bed surface wear have not been overcome satisfactorily.

SUMMARY OF THE INVENTION

Among the several objects and features of this invention may be noted the provision of an exercise treadmill having an improved slider bed suspension system which solidly supports the slider bed plate and the upper reach of the treadmill belt during use under the impact of a user's foot while walking or running thereon, but which effectively dissipates heat frictionally generated by the belt and slider bed surface itself, and thus increases belt and slider bed surface life;

The provision of such an exercise treadmill in which the improved slider bed realizes a natural convection air flow thereunder, thereby to promote the dissipation of heat;

The provision of such an exercise treadmill which flexes, at least within a limited design range, in vertical direction thereby to cushion the impact of a runner's foot on the upper reach of the belt supported by the slider bed so as to absorb and distribute the shock through the frame for the treadmill, but yet which does not result in cocking of the rollers supporting the belt such that the belt runs true; and The provision of such an exercise treadmill which is of rugged and simple construction, which has a long service life, which may be readily adjusted to accommodate a variety of uses and speeds, which is attractive in appearance, and which is economical to manufacture and use.

Other objects and features of this invention will be in part apparent and in part pointed out hereinafter.

Briefly stated, an exercise treadmill of the present invention has a frame, the frame comprising a pair of spaced side members extending generally lengthwise of the treadmill. A pair of generally parallel, spaced rollers is journaled between the side members, with the rollers extending transversely between the side members. An endless belt is entrained around the rollers, and the belt has an upper reach on which the user of the treadmill runs or walks, and a lower reach. Means is provided for driving one of the rollers and the belt entrained therearound, with the belt moving along an endless path around the rollers. Further, means carried by the frame is provided for supporting the upper reach of the belt and for effectively dissipating heat therefrom generated by the friction of the upper reach of the belt rubbing on the support means. The support means is defined to comprise a metal plate disposed below the upper reach of the belt, the plate having a length sufficient to substantially continuously support the upper reach of the belt between the rollers, and having a width somewhat less than the distance between the side members such that a gap is present between the sides of the plate and each of the side members. The support means further comprises a plurality of transverse beams disposed below the upper reach of the plate, with the plate bearing on these transverse beams. The beams are spaced apart from one another with the area of the plate in contact with the beams being small in relation to the area between the beams such that the frictional heat generated by the belt rubbing on the plate is conducted from the belt into the plate. Thus, between the upper and lower reaches of the belt is heated by the lower face of the plate, and the heated air is exhausted from below the plate via the gaps between the sides of the plate and the support beams.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
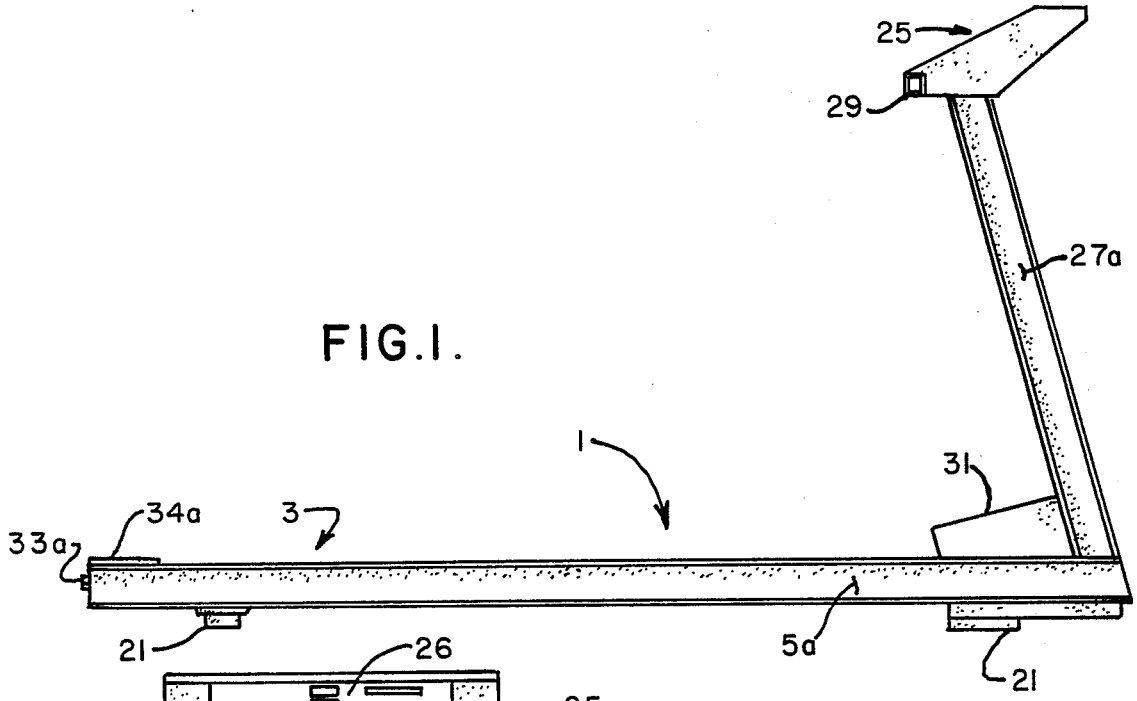
FIG. 1 is a side elevation view of the exercise treadmill of the present invention.
Figure 2:
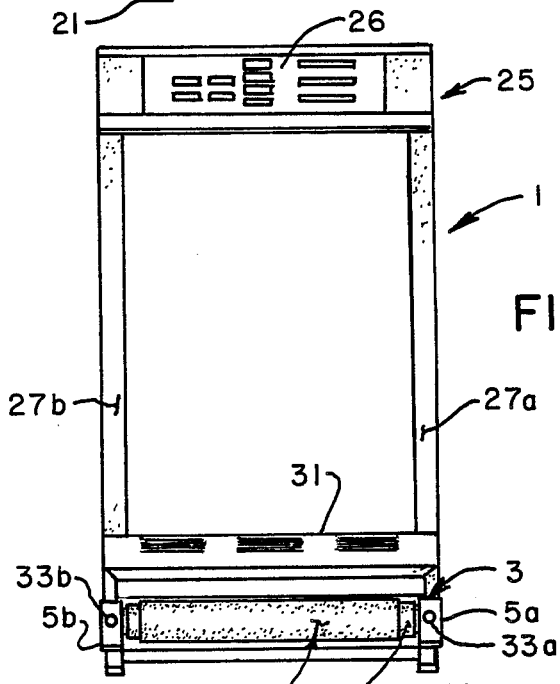
FIG. 2 is a left end elevational view of FIG. 1.
Figure 3:
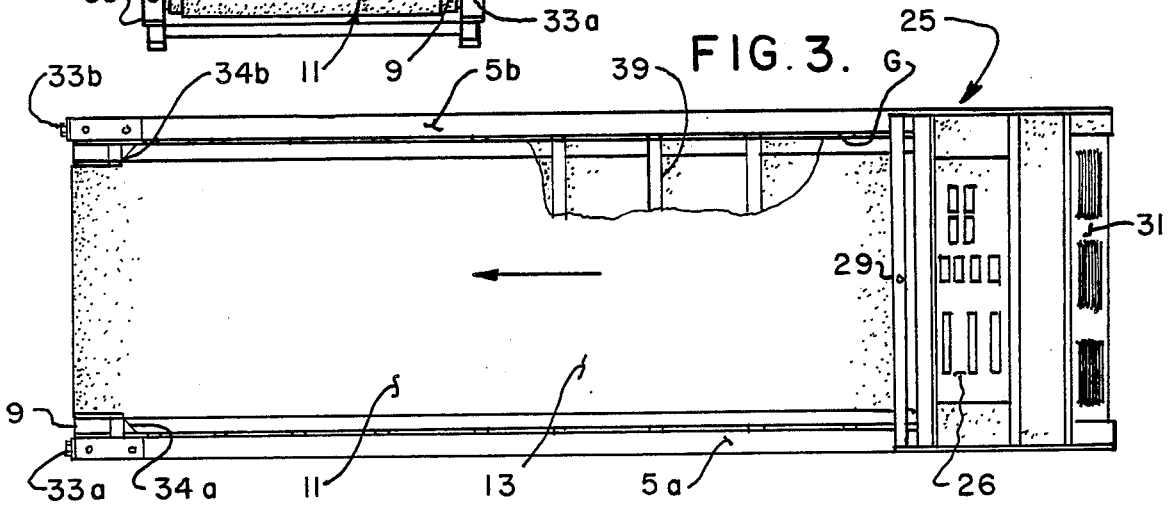
FIG. 3 is a top plan view of FIG. 1, illustrating the upper reach of the belt, and further illustrating a slider bed supported by a plurality (e.g., nine) of transverse support beams extending between the side frame members of the treadmill frame, with a gap between the side members and the slider plate.

Referring now to the drawings, and more particularly to FIGS. 1–3, an exercise treadmill of the present invention is indicated in its entirety by reference character 1. More specifically, exercise treadmill 1 includes a frame 3 having a pair of spaced side channels 5*a*, 5*b* extending lengthwise of the frame. A front roller 7 and a rear roller 9 are journaled between the side members, generally at the front and rear ends of the side channels. An endless belt 11 is entrained around the front and rear rollers, with the belt having an upper reach 13 and a lower reach 15. As shown in FIG. 3, the upper reach 13 of the belt moves from front to rear so that a user standing on the upper surface of the upper reach of the belt would have to walk or run in forward direction (to the right as shown in FIGS. 1 and 3) to remain stationary relative to frame 3 of the exercise treadmill at a predetermined speed to remain stationary relative to the treadmill frame. Front roller 7 is rotatably driven by a variable speed DC electric motor 17, with the motor being connected to the front roller by means of a belt and pulley drive 19. A plurality of support feet 21 of solid rubber pads or the like are provided on the bottom faces of side channels 5*a* and 5*b* at the forward and rear ends thereof, such that the side channels are simply supported on the support feet above the level of the floor. A front frame member 23 is secured to and extends between the forward ends of side channels 5*a*, 5*b*.

As generally indicated at 25, a control panel is provided at the front end of exercise treadmill 1 in position so that the display panel may be readily viewed by a user of the treadmill when the user is walking or running on the upper reach 13 of the belt. More specifically, control panel 25 includes a plurality of switches for controlling the operation of drive motor 17 thereby to stop and start the motor and to regulate the speed and the duration of energization of the motor. Also, certain displays readouts 26 may be provided for showing the surface speed of the belt and hence the velocity at which the user is walking or running. Control panel 25 is supported by a pair of support arms 27*a*, 27*b* secured to respective side channels 5*a*and 5*b*, and extending upwardly and rearwardly from the front ends thereof. A handlebar 29 is solidly carried by the control panel, and provides a grip for the user while walking or running on the upper reach 13 of treadmill belt 11. A cover 31 is provided for motor 17 and for the belt and pulley drive 19. At the rear end of side channels 5*a* and 5*b*, respective adjustable bolts 33*a*, 33*b* effect fore and aft movement of rear roller 9 thereby to adjust the tension on endless belt 11 and to adjust the belt to prevent tracking of the belt relative to the rollers. Still further, guard covers 34*a*, 34*b* on the upper faces of respective side channels 5*a*, 5*b* overlie the portion of the outer margins of the upper reach of the belt so as to prevent articles of clothing, fingers, toes, or other items from inadvertently being pinched between the upper reach of the belt as it is entrained around rear roller 9.

Figure 4:
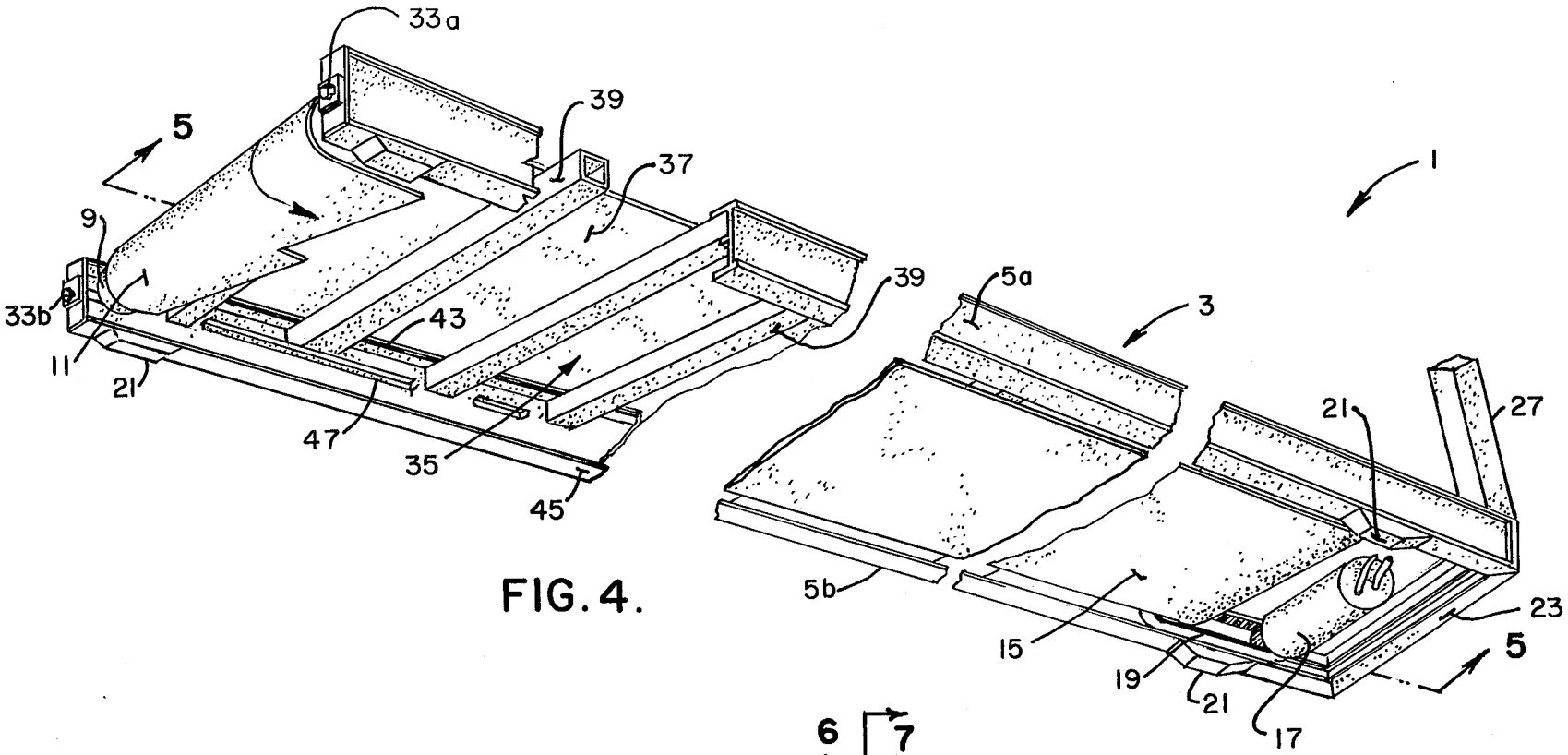
FIG. 4 is a bottom perspective view of the exercise treadmill, with parts broken away for clarity, illustrating the upper and lower reaches of the belt, the slider plate supporting the upper reach of the belt, and further illustrating a plurality of transverse side beams supporting the slider plate.
Figure 5:
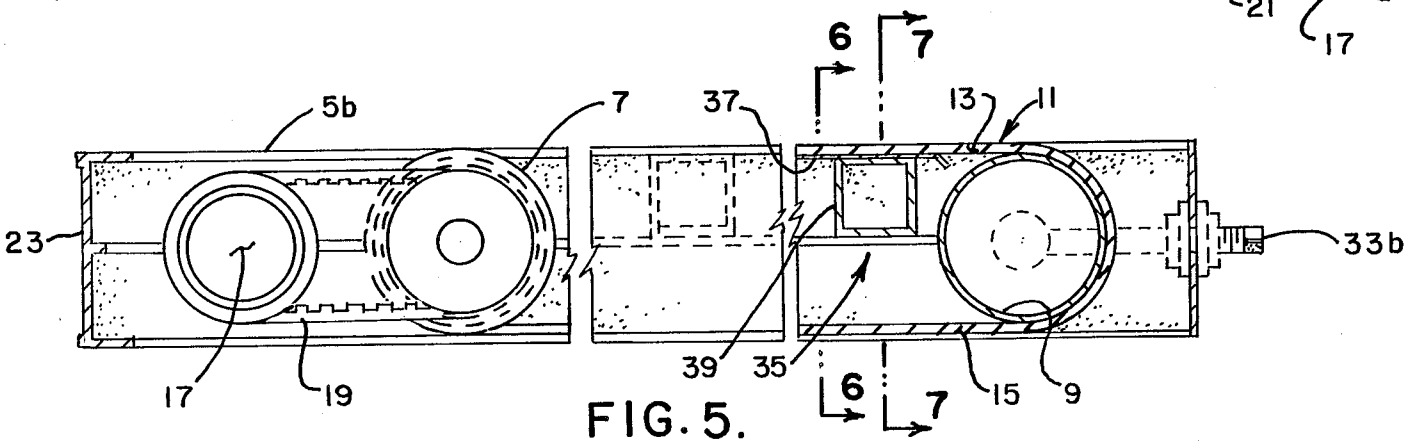
FIG. 5 is a longitudinal cross sectional view of the exercise treadmill of the present invention, taken along line 5—5 of FIG. 4.
Figure 6:
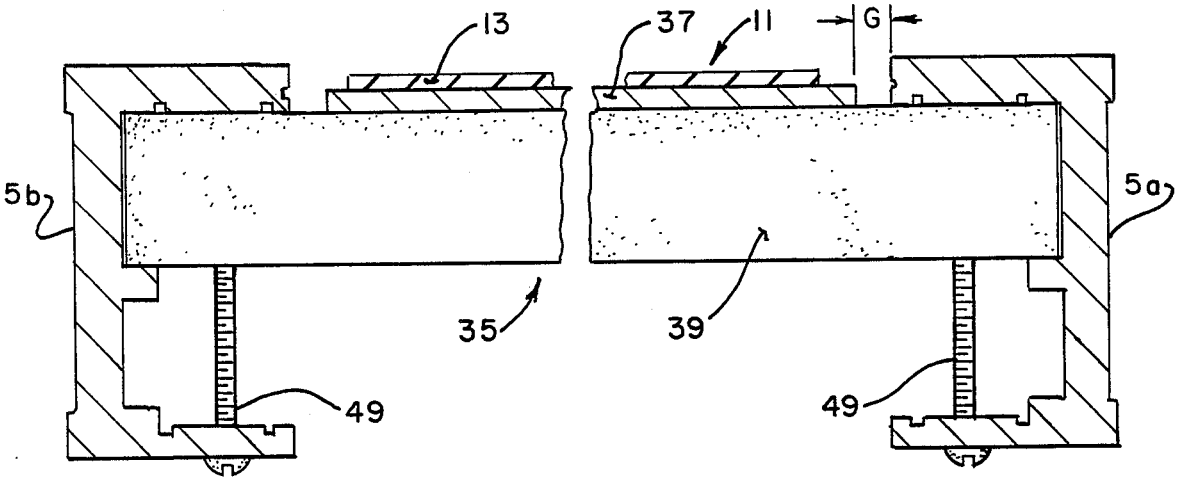
FIG. 6 is a cross sectional view, taken along line 6—6 of FIG. 5 on a somewhat enlarged scale.
Figure 7:
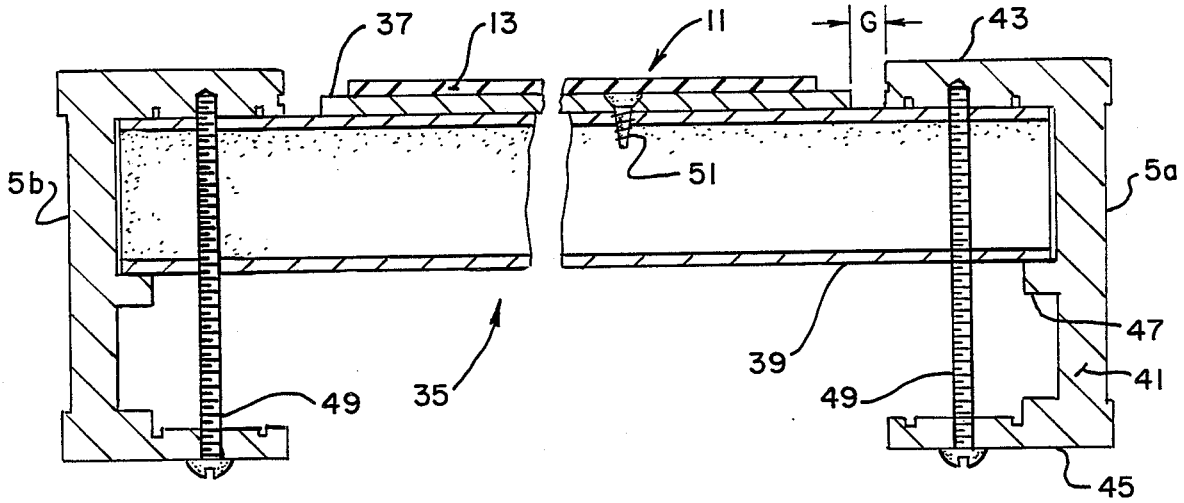
FIG. 7 is a view similar to FIG. 6, taken along line 7—7 of FIG. 5.

An improved slider bed, as generally indicated at 35, for supporting the upper reach 13 of belt 11, will now be defined in detail. More specifically, the improved slider bed 35 of the present invention comprises a stationary metal plate 37, preferably of a heat-conductive metal alloy such as aluminum or the like, is shown to have a length extending substantially between front roller 7 and rear roller 9, and preferably having a width somewhat greater than the width of endless belt 11 and extending out beyond the sides of the belt (as best shown in FIGS. 4, 6, and 7), with the outer edges of the belt terminating short of the side edges of plate 37 such that a gap G (see FIGS. 6 and 7) is provided between the edge of the stationary slider plate and the inner edges of the support channels 5*a* and 5*b*. Preferably, this gap G is about one-quarter inch (6 mm.) wide. However, it will be understood that the width of this gap may vary, depending on a number of factors, so long as a sufficient gap is provided so as to permit the ready exchange of heated air from beneath slider plate 37 via the gap. Further, slider bed 35 comprises a plurality (e.g., nine) transverse support beams 39 spaced from one another and extending transversely between side channels 5*a*, 5*b* for solidly supporting stationary slider plate 37. More specifically, these transverse support beams 39 are shown to be square hollow tubing members, solidly supported with respect to the side channel frame members at their ends. The slider plate 37 bears directly on the top surface of these support beams and, as is illustrated best in FIG. 3, the portions of the underside of slider plate 37 in contact with the transverse support beams are relatively small as compared to the area of the slider plate between the transverse support beams. In this manner, it will be appreciated that the majority of the undersurface of stationary plate 37 is exposed to ambient air within the space between the upper and lower reaches 13 and 15 of endless belt 11. Thus, the heated undersurface of the stationary bed plate 37 is cooled by means of natural convection air currents, and the convection-heated air is free to flow along the underside of the stationary bed plate 37, and to be exhausted to the surroundings via the gaps G at each side of the stationary plate substantially along the entire length of the treadmill. Of course, cooler, ambient air will flow into the space between the upper and lower reaches of the belt as the heated air is exhausted from gaps G, and thus natural convection will cause a continuous flow of cooling air under the exposed surfaces of slider plate 37 without the requirement of any cooling fans or the like. In this manner, heat generated by the friction of the upper reach of the belt frictionally sliding on stationary slider plate 37 can be effectively dissipated, maintaining the temperature of the belt well within acceptable limits for long slider belt surface and belt life, and yet a solid support surface (as opposed to rollers or the like) is provided for the user of exercise treadmill 1.

Referring now more specifically to FIGS. 6 and 7, it will be seen that each of the side channels 5*a*, 5*b* is an E-shaped channel member, preferably of a suitable aluminum extrusion or the like. More specifically, each of the side channels has a vertical web 41, an upper flange 43, a lower flange 45, and a center flange or ledge 47. The distance between the underside of upper flange 43 and the upper face of the center ledge 47 is sufficient to readily, but snuggly, accommodate transverse support beams 39 such that the center ledge solidly supports the outer under surface of the transverse support beams. An elongate bolt 49 is inserted through apertures through the lower flange 45 of the channel member, and through corresponding apertures provided in the ends of each of the transverse support beams 39. Further, the bolts are threadably engaged with a threaded aperture provided in the under face of upper flange 43 of the support beams such that each of the transverse support beams is securely and rigidly fastened to the side channels. In this manner, a solid securement of each of the transverse support beams is readily and inexpensively carried out. Further, countersunk screws, as indicated at 51 (see FIG. 7) are provided so as to rigidly secure stationary slider plate 37 to the upper face of the transverse support beams 39. These screws 51 positively securing stationary slider plate 37 to the upper face of transverse supports beams 39 provide a positive shear tie between the slider plate and the support beams such that the support beams and the slider plate function as a unitary member, thus enhancing the stiffness of the combination of the stationary slider plate and the transverse support beams in tranverse direction. However, because only the relatively thin stationary plate extends lengthwise between the adjacent spaced transverse support beams, the slider bed 35 of the present invention is able to flex of a certain limited degree in lengthwise direction.

Further in accordance with this invention, the stiffness of side channels 5*a*, 5*b* of the present invention is designed such that the side channels will flex within a desired limited range in generally vertical direction upon a user of average weight running or walking on upper reach 13 of the belt. More specifically, with the side channels 5*a*, 5*b* simply supported on support feet 21 (as best shown in FIG. 1), and with the user grasping handlebar 29 such that the user's feet impact the upper reach 13 of the belt and the support bed 35 generally at the midpoint between the front and rear support feet 21, the side frame channels 5*a*, 5*b* will flex downwardly $\frac{1}{8}$ to $\frac{1}{4}$ inch under the impact of the user's feet striking the bed thereby to cushion the impact of the user's feet and to absorb the shock and to distribute it throughout frame 3. Because of the construction of the transverse beams and the stationary slider plate rigidly affixed thereto by means of screws 51, the slider bed is relatively stiff in transverse direction, and thus the entire frame 3 is resistant to torsional flexure such that the front and rear rollers are maintained in their desired parallel relation thereby substantially reducing any tendency of belt 11 to become canted on the front and rear rollers.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. An exercise treadmill having a frame, said frame comprising a pair of spaced side members extending generally lengthwise of said treadmill, a pair of generally parallel, spaced rollers journaled on said side members and extending transversely between said side members, an endless belt entrained around said rollers, said belt having an upper reach on which a user of said treadmill runs or walks and a lower reach, means for driving one of said rollers and said belt, said belt moving along an endless path around said rollers, and means carried by said frame for supporting said upper reach of said belt and for effectively dissipating heat therefrom generated by the friction of said upper reach of said belt rubbing on said supporting means, said support means comprising a metal plate disposed generally at the elevation of said frame side members and below said upper reach of said belt having a length sufficient so as to substantially continuously support said upper reach between said rollers and a width somewhat less than the distance between said side members such that a gap is present between the sides of said plate and each of said side members, said support means further comprising a plurality of transverse beams disposed below said upper reach with said plate bearing thereon, said beams being secured to said side frame members and being spaced from one another, with the area of said plate in contact with said beams being small in relation to the area between said beams such that frictional heat generated by said rubbing on said plate is conducted from said belt into said plate, and such that relatively cool ambient air between the upper and lower reaches of said belt is heated by the lower face of said face, and such that the heated air is exhausted from the below said plate via said gaps, said beams being sufficiently flexible in vertical direction so as to at least in part cushion the impact of a runner's feet on said belt.

2. An exercise treadmill as set forth in claim 1 wherein each of said side members is generally channel-shaped in cross section, having a generally vertical web and inwardly projecting side flanges at the top and bottom of said web.

3. An exercise treadmill as set forth in claim 2 wherein said gap is defined by the side edges of said plate, and by the inner edges of said upper flanges of each of said channel-shaped side members.

4. An exercise treadmill as set forth in claim 2 wherein said transverse beams are secured at their ends to said webs of said channel-shaped members.

5. An exercise treadmill as set forth in claim 2 wherein said channels are simply supported adjacent their ends such that the midportions of said side members are substantially free to flex in vertical direction upon a user running or walking on the upper reach of said belt supported by said plate and said transverse beams thereby to cushion and transfer shock from the impact of the user's feet on said belt.

6. An exercise treadmill as set forth in claim 1 wherein said plate is rigidly secured to said transverse beams in such manner that said transverse beams are relatively stiff in transverse direction, and yet permit limited vertical flexing movement of said frame.

7. In an exercise treadmill having a frame, said frame comprising a pair of spaced side members extending generally lengthwise of said treadmill, a pair of generally parallel spaced rollers journaled on said side members and extending transversely therebetween, an endless belt entrained around said rollers, said belt having an upper reach on which a user of the treadmill runs or walks and a lower reach, means for driving one of said rollers and said belt, said belt moving along an endless path around said rollers, and a stationary slider bed carried by said frame for supporting said upper reach of said belt, wherein the improvement comprises: said stationary slider bed comprising a stationary plate disposed beneath said upper reach of said belt, said plate being of a heat-conductive metal, and being relatively thin such that the plate supported at its edges would be incapable of supporting the weight of a user on the upper reach of said belt, a plurality of transverse support beams spaced from one another and extending transversely between said side members, the ends of said support beams being rigidly secured to said side members, said plate being positively secured to the upper surfaces of said transverse support beams, the area of the undersurface of said plate contacted by said transverse support beams being relatively small in relation to the underface of said plate between said transverse support beams, said plate being of a width somewhat less than the distance between the inner edges of said side members such that a gap is present between the inner edge of each side member and a corresponding edge of said side plate, said gaps being of a sufficient width so as to permit air heated on the underface of said slider plate to be exhausted from between the upper and lower reaches of the belt via said gaps.

* * * * *